US006085400A

United States Patent [19]

Liu

[11] Patent Number: 6,085,400

[45] Date of Patent: Jul. 11, 2000

[54] RIVETING PLIERS

[76] Inventor: Yang-Ting Liu, No. 76-1 Lin 4, Shang-Kuan Li, Yuan Li Town, Miao Li Hsien, Taiwan

[21] Appl. No.: 09/383,360

[22] Filed: Aug. 26, 1999

[51] Int. Cl.[7] ..... B21J 15/34

[52] U.S. Cl. ..... 29/243.521; 72/391.4; 227/55

[58] Field of Search ..... 72/391.4; 29/243.521, 29/243.527, 243.528; 227/55

[56] References Cited

U.S. PATENT DOCUMENTS

| | | | |
|---|---|---|---|
| 4,353,239 | 10/1982 | Fujimoto | 72/391.4 |
| 4,807,460 | 2/1989 | Tzong | 72/391.4 |
| 5,437,085 | 8/1995 | Liu | 29/243.521 |

*Primary Examiner*—David Jones
*Attorney, Agent, or Firm*—Rosenberg, Klein & Lee

[57] ABSTRACT

A riveting pliers, which includes a casing having a rear end terminating in a hand grip, a sleeve mounted in the casing, a handle pivoted to the casing, a pressure bar pivoted to the casing, and links coupled between the pressure bar and the handle for enabling the pressure bar to be turned by the handle to lift the sleeve in the casing in achieving a riveting operation, wherein the pressure bar has a middle part pivoted to the inside of the casing by a pivot, a forked front end clamped on two recessed portions at the periphery of the sleeve at two opposite sides, a forked rear end mounted with a transverse pivot and a roller on the transverse pivot; the handle has a downward sloping flange stopped at the roller at the pressure bar for imparting a pressure to the pressure bar to lift the sleeve upon each operation of the handle.

1 Claim, 3 Drawing Sheets

RIVETING PLIERS

BACKGROUND OF THE INVENTION

The present invention relates to a riveting pliers, and more particularly to such a riveting pliers which can be operated with less effort to pull a nail, casing the plain end of a rivet to be forced by the nail to expand and to form another head.

A riveting pliers is designed for riveting a rivet by pulling a nail relative to the rivet. When the nail is pulled, the rivet is forced to expand, thereby causing the plain end of the rivet to form another head. A regular riveting pliers comprises a transmission mechanism for transmitting the applied force from the user to the nail. The transmission mechanism according to the prior art riveting pliers is generally comprised of a pair of hand grips, link means, and a pressure bar assembly. The hand grips are lever means pivoted to a casing. The pressure bar is pivoted to the casing and clamped on nail retainer means. The link means is coupled between the hand grips and the pressure bar. This structure of riveting pliers is functional, however it consumes much effort upon each riveting operation. Further, the pivot means between the link and the pressure bar/hand grips wear quickly with use.

SUMMARY OF THE INVENTION

The present invention has been accomplished to provide a riveting pliers, which achieves a riveting operation with less effort. According to the present invention, the riveting pliers comprises a casing having a rear end terminating in a hand grip, a sleeve mounted in the casing, a handle pivoted to the casing, a pressure bar pivoted to the casing, and links coupled between the pressure bar and the handle for enabling the pressure bar to be turned by the handle to lift the sleeve in the casing in achieving a riveting operation, wherein the pressure bar has a middle part pivoted to the inside of the casing by a pivot, a forked front end clamped on two recessed portions at the periphery of the sleeve at two opposite sides, a forked rear end mounted with a transverse pivot and a roller on the transverse pivot; the handle has a downward sloping flange stopped at the roller at the pressure bar for imparting a pressure to the pressure bar to lift the sleeve upon each operation of the handle.

DETAILED DESCRIPTION OF THE PREFERRED EMBODIMENT

Figure 1:
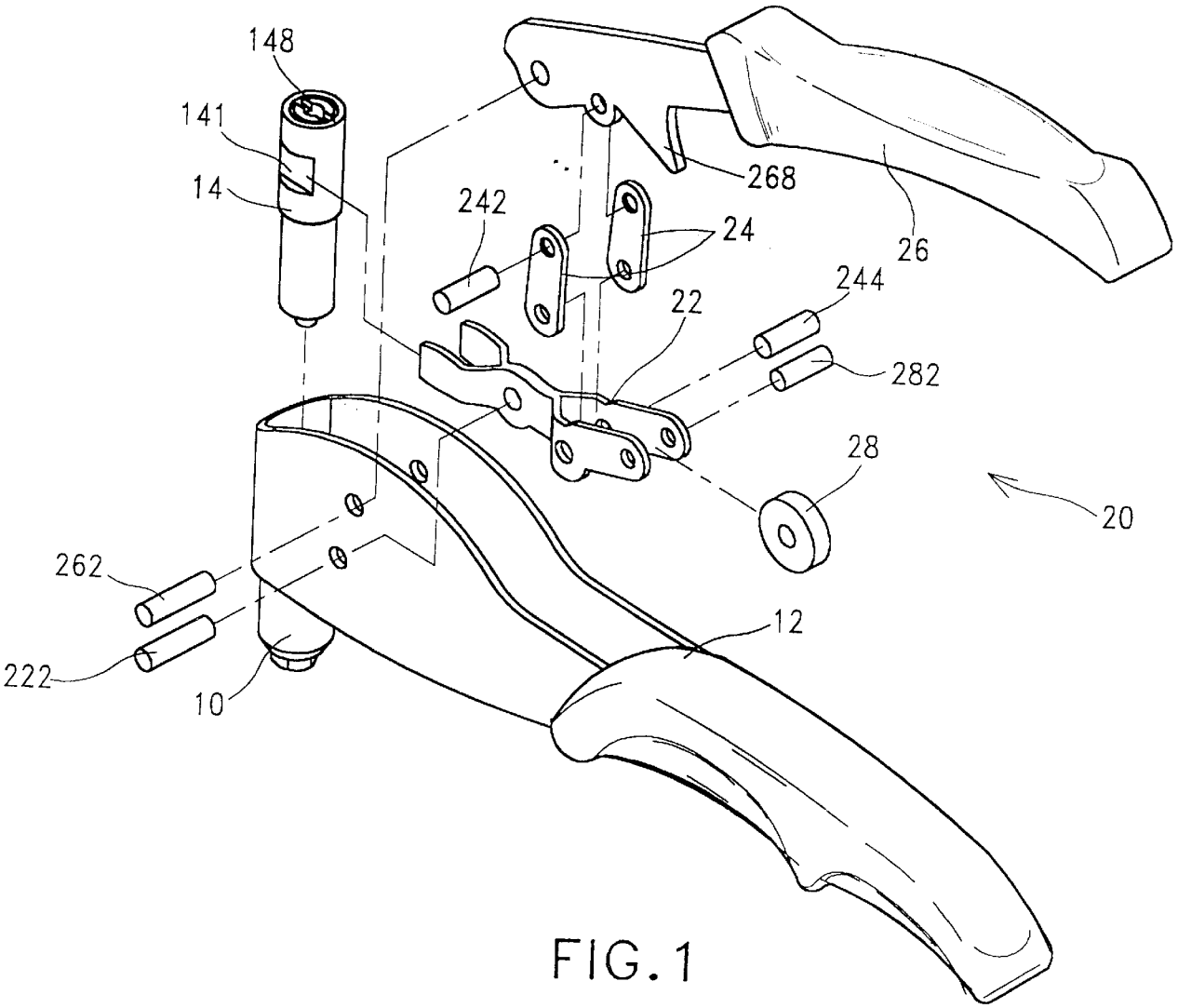
FIG. 1 is an exploded view of a riveting pliers according to the present invention.
Figure 2:
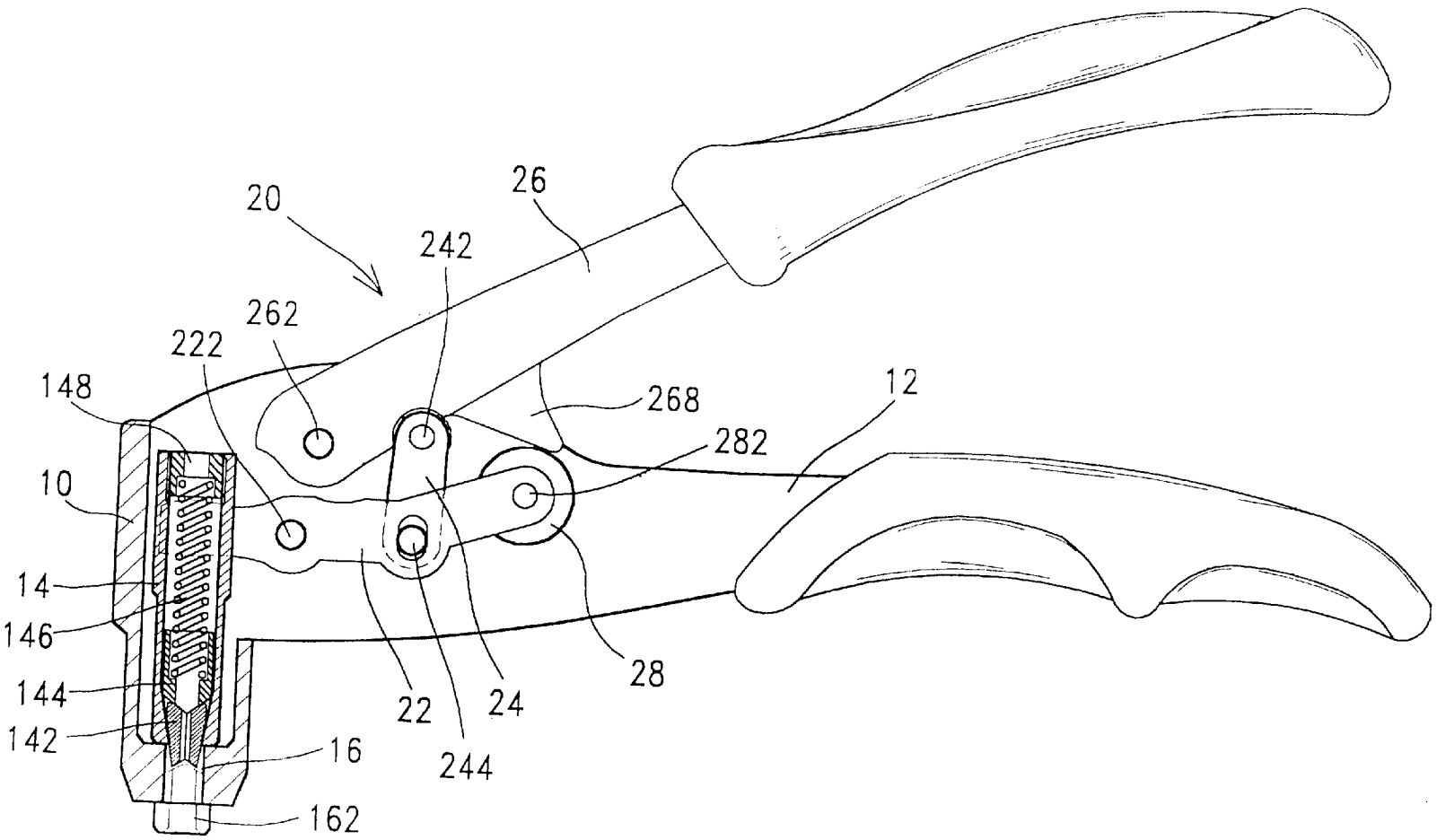
FIG. 2 is a sectional assembly view of the riveting pliers according to the present invention.

Referring to FIGS. 1 and 2, a riveting pliers in accordance with the present invention comprises a hollow, elongated casing 10, a sleeve 14, and a transmission mechanism 20. The casing 10 has one end terminating in a hand grip 12. The sleeve 14 is vertically mounted in the casing 10 at a front side, having a tapered front end and two recessed portions 141 at the periphery thereof at two opposite sides. A plurality of jaw plates 142 are mounted in the tapered front end of the sleeve 14. An annular block 144 is mounted in the sleeve 14 and supported on the jaw plates 142. A compression spring 146 is mounted in the sleeve 14 and supported on the block 144. An annular screw 148 is threaded into the sleeve 14 to hold down the compression spring 146. The casing 10 further comprises a bottom sliding hole 16 vertically disposed near its front side, and a hollow guide bolt 162 fastened to the bottom sliding hole 16. The transmission mechanism 20 comprises a pressure bar 22, two links 24, and a handle 26. The pressure bar 22 has a middle part pivoted to the inside of the casing 10 by a pivot 222, a forked front end clamped on the recessed portions 141 at the sleeve 14, and a forked rear end mounted with a first transverse pivot 244, a second transverse pivot 262 behind the first transverse pivot 244, and a roller 28 on the transverse pivot 262. The handle 26 has its front end pivoted to the casing 10 above the forked front end of the pressure bar 22 by a pivot 262, and a downward sloping flange 268. A pivot 242 is transversely mounted on the handle 26 in front of the downward sloping flange 268. The links 24 are bilaterally coupled between the pivot 242 at the handle 26 and the first transverse pivot 244 at the pressure bar 22. After installation, the downward sloping flange 268 is stopped at the roller 28.

Figure 3A:
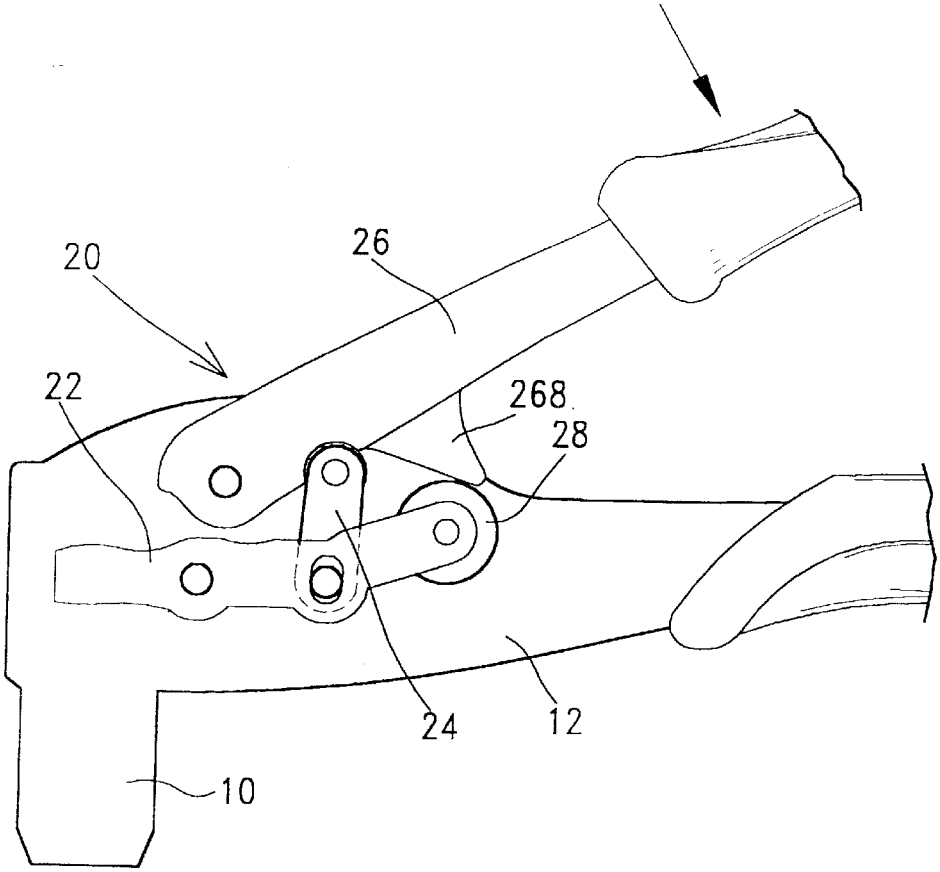
FIG. 3A is a schematic drawing showing the operation of the transmission mechanism according to the present invention (Step I).
Figure 3B:
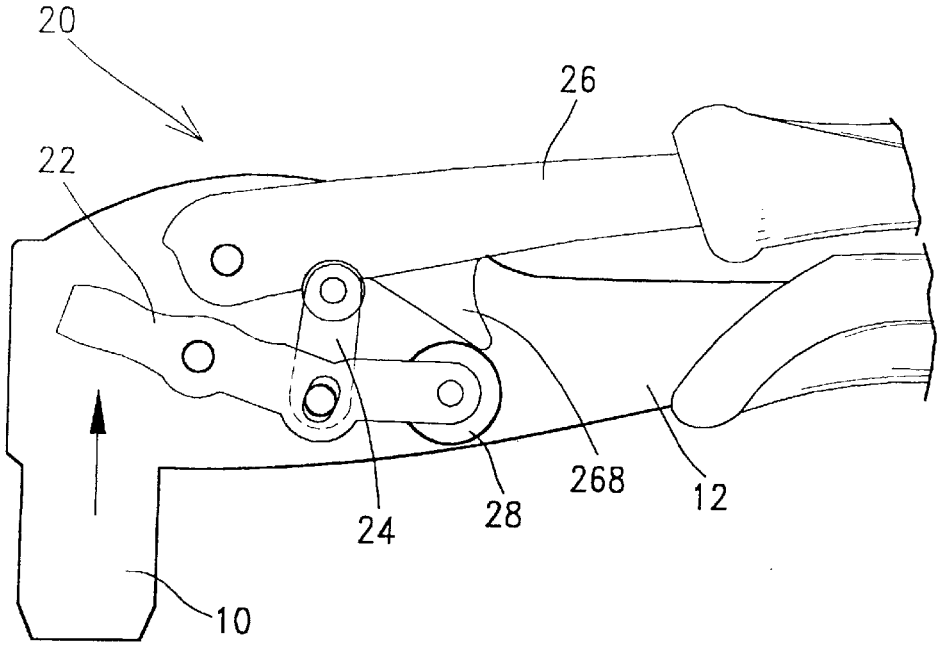
FIG. 3B is a schematic drawing showing the operation of the transmission mechanism according to the present invention (Step II).

Referring to FIGS. 3A and 3B, when pulling the rivet to achieve riveting, the handle 26 is pressed down toward the hand grip 12 of the casing 10. When pressing the handle 26 downwards toward the hand grip 12 of the casing 10, the roller 28 is forced by the downward sloping flange 268 of the handle 26 to push the pressure bar 22, thereby causing the pressure bar 22 to turn about the pivot 222 and to lift the sleeve 14, so as to achieve a riveting operation. Because the pressure bar 22 is turned about the pivot 222 inside the casing 10 with its forked front end clamped on the recessed portions 141 at the sleeve 14 and forked rear end coupled to the handle 26 by the links 24, the pressure bar 22 can easily be moved to lift the sleeve 14 by closing the handle 26 on the casing 10 with less effort. Because the downward sloping flange 268 of the handle 26 is maintained stopped at the roller 28, driving force is positively transmitted from the handle 26 to the sleeve 14 through the pressure bar 22 each time the handle 26 is pressed down.

While only one embodiment of the present invention has been shown and described, it will be understood that various modifications and changes could be made thereunto without departing from the spirit and scope of the invention disclosed.

What the invention claimed is:

1. A riveting pliers comprising:

a casing, said casing comprising a bottom sliding hole and a hollow guide fixedly provided at said bottom sliding hole;

a sleeve vertically mounted in said casing in vertical alignment with said bottom sliding hole, said sleeve having a tapered front end;

a plurality of jaw plates mounted in the tapered front end of said sleeve;

an annular block mounted in said sleeve and supported on said jaw plates;

an annular screw threaded into said sleeve;

a compression spring mounted in said sleeve and retained between said annular block and said annular screw;

a handle having a front end pivoted to said casing;

a pressure bar driven by said handle to lift said sleeve in said casing; and at least one link coupled between said handle and said pressure bar;

wherein said pressure bar has a middle part pivoted to the inside of said casing by a pivot, a forked front end clamped on two recessed portions at the periphery of said sleeve at two opposite sides, a forked rear end mounted with a transverse pivot and a roller on said transverse pivot; said handle has a downward sloping flange stopped at the roller at said pressure bar; and at least one link each has a top end pivoted to said handle in front of said downward sloping flange and a bottom end pivoted to the forked rear end of said pressure bar in front of the transverse pivot at said pressure bar.

* * * * *